United States Patent [19]

Jensen et al.

[11] Patent Number: 4,990,379

[45] Date of Patent: Feb. 5, 1991

[54] HEAT RECOVERABLE ARTICLE

[75] Inventors: Per J. T. Jensen, Slangerup; Joergen M. Berth, Kvistgaard, both of Denmark

[73] Assignee: Raychem Corporation, Menlo Park, Calif.

[21] Appl. No.: 241,659

[22] Filed: Sep. 8, 1988

[30] Foreign Application Priority Data

Aug. 25, 1987 [GB] United Kingdom ..... 8720025

[51] Int. Cl.[5] ..... H05B 3/10

[52] U.S. Cl. ..... 428/349; 174/DIG. 8; 219/535; 219/549; 428/35.1

[58] Field of Search ..... 428/35.1, 34.9; 219/535, 549; 174/DIG. 8

[56] References Cited

U.S. PATENT DOCUMENTS

| | | | |
|---|---|---|---|
| 2,027,962 | 1/1936 | Currie | 18/55 |
| 3,086,242 | 4/1963 | Cook et al. | 18/1 |
| 3,597,372 | 8/1971 | Cook et al. | 260/4 |
| 4,412,125 | 10/1983 | Nagasawa et al. | 219/535 |
| 4,532,164 | 7/1985 | Clounch, II et al. | 219/535 |
| 4,570,055 | 2/1986 | McMills | 219/535 |
| 4,596,732 | 6/1986 | Diaz | 174/DIG. 8 |
| 4,648,924 | 3/1987 | Nolf | 156/85 |
| 4,675,512 | 6/1987 | Douret et al. | 219/535 |

FOREIGN PATENT DOCUMENTS

| | | |
|---|---|---|
| 179657A | 10/1985 | European Pat. Off. . |
| 1265194 | 3/1972 | United Kingdom . |
| 1434069 | 4/1976 | United Kingdom . |
| 1437177 | 5/1976 | United Kingdom . |
| 2012149 | 6/1982 | United Kingdom . |
| 2091371A | 7/1982 | United Kingdom . |
| 2136259A | 9/1984 | United Kingdom . |
| 2181507A | 4/1987 | United Kingdom . |
| 2148615 | 9/1987 | United Kingdom . |

*Primary Examiner*—James Seidleck
*Attorney, Agent, or Firm*—Timothy Richardson; Herbert Burkard

[57] ABSTRACT

A tubular article comprises an electrically conductive polymeric material. The article increases in wall thickness on recovery. It can be used for example as a duct seal or as an internal coupler or seal for hollow conduits such as pipes. The article may have plain or convoluted walls.

5 Claims, 2 Drawing Sheets

HEAT RECOVERABLE ARTICLE

BACKGROUND OF THE INVENTION (1) Field of the Invention

This invention relates to an electrically heat recoverable article which increases its wall thickness on recovery. One application of the invention is sealing a space between an elongate object and a surface surrounding the elongate object. Another application is an internal seal or coupler for hollow conduits such as pipes.

(2) Introduction to the Invention

A common example where sealing is needed between an elongate object and a surface surrounding the or each object is for ducts and supply lines, where some form of seal therefore has to be provided either around the substrate (for example in the case of a supply line) or between two substrates (for example in the case of a duct seal between the duct and a supply line it carries). Other similar applications also exist for sealing between elongate objects such as pipes and cables and substrates surrounding or carried within the elongate objects. The substrates and elongate objects may have irregular surfaces.

Various techniques have been used in the past for forming such seals. The simplest perhaps is a tape wrap which has the advantage that a single product could be used over virtually any size or shape of substrate, but the disadvantage of poor performance. Sealing materials such as adhesives or mastics may be used alone or with tapes, but again performance is poor.

In recent years dimensionally-recoverable articles have been used for sealing supply lines and as duct seals. In general, a dimensionally-recoverable article is an article the dimensional configuration of which may be made substantially to change when subjected to a suitable treatment, for example heating. Usually these articles recover towards an original shape from which they have previously been deformed but the term also includes an article which adopts a new configuration even if it has not previously been deformed.

In their most common form such articles comprise a heatshrinkable sleeve made from a polymeric material exhibiting the property of elastic or plastic memory as described, for example, in U.S. Pat. Nos. 2,027,962, 3,086,242 and 3,597,372. In the production of heat-recoverable articles, the polymeric material may be cross-linked at any stage in the production of the article that will enhance the desired dimensional recoverability.

An advantage of these articles is that they are strong, impermeable, water resistant and well able to resist such agencies as the small mechanical stresses caused by temperature variation, earth movements and repair work. They can be easily installed in their recoverable configuration and then caused to shrink (or otherwise recover) into sealing engagement with the substrate that they are to protect. In this way, ease of installation can be combined with excellent performance. A single size of product may be used with a variety of sizes of substrate, and close tolerances in manufacture may be avoided.

A difficulty, however, remains in some circumstances. The very fact that these articles recover on heating means that in general heat must be applied when the article is in approximately the desired position with respect to the substrate. This may be a problem where the substrate or some article nearby physically prevents or hinders proper positioning of a torch or other heating means, or where it may be damaged by excessive heat.

European patent application Publication No. 0179657 (B108) describes an article which can be heated away from the desired installation position, and then brought into contact with the surrounding surface by activation of a resilient biasing member.

It is also known for recoverable articles to comprise conductive polymeric materials which can be heated to effect recovery by passing electrical current therethrough. As an example GB No. 1265194 describes a conductive polymeric, shrinkable tubular layer, which is optionally used in conjunction with a non-conductive shrinkable tubular layer. Current is supplied to the conductive layer by alligator clips. The passage of the current heats and hence recovers the article.

It is also known to be desirable to use for a conductive recoverable article, a material which exhibits a PTC (positive temperature coefficient of resistivity) effect, that is a sharp rise in resistivity at a particular, or over a short range of temperatures. This temperature or temperature range is known as the anomaly or switching temperature. Typically the material is selected to exhibit the sharp rise in temperature at or slightly above the recovery temperature of the article. The PTC effect minimises overheating and consequent so-called "thermal runaway" of the material. Materials which exhibit a PTC effect are typically referred to simply as PTC materials.

SUMMARY OF THE INVENTION

We have discovered a new article and method which can be used to seal a space between an elongate object and a surrounding surface, which uses an electrically recoverable, conductive polymeric material. The object can be positioned in the desired installation position, with electrical wires leading away from the installation position for connection and recovery of the article.

Thus a first aspect of the invention provides a tubular heat-recoverable article, which has been deformed to render it recoverable, comprising an electrically conductive polymeric material and electrical connection means, the deformation of the article and the position of the electrical connection means being such that when the electrical connection means are electrically connected to an appropriate source of electrical power, electrical current flows through at least one region of the article, heating and recovering the article, whereby on recovery at least a section of the article increases in wall thickness.

The electrical connection means may be actual electrodes, or may be part of the article to which electrodes can conveniently be attached.

One application of the article is to seal a space between an elongate object and a surface surrounding the object. In this case the increase in wall thickness of the article is preferably arranged to seal the space between the elongate object and surrounding surface.

Tubular articles according to the invention are deformed so that on recovery they increase in wall thickness. This may be done in any suitable way. As an example, the articles may be stretched longitudinally.

A second aspect of the invention provides a method of forming a seal between at least one elongate object and a surface surrounding the or each object, which comprises:

(a) positioning between the object and the surface a tubular heat-recoverable article which has been deformed to render it heat-recoverable, and which comprises electrically conductive polymeric material, and at least two electrical connection means;

(b) connecting the electrical connection means to a source of electrical power to cause electrical current to flow between the connection means to heat and hence to recover the article;

the position of the electrical connections means, and the deformation of the article being such that recovery causes the article to increase its wall thickness to seal the space between the elongate object and surrounding surface.

DETAILED DESCRIPTION OF THE INVENTION

Figure 1:
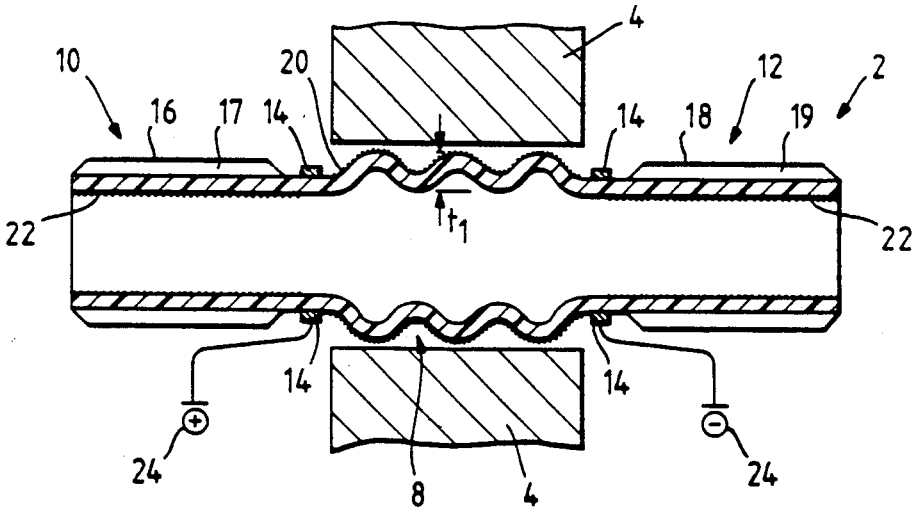
FIG. 1 is a sectional view showing an article according to the invention for sealing between a cable and a hole in a wall, prior to recovery.

In some articles according to the invention at least one transverse dimension of the article increases on recovery. For example, the diameter may increase for articles which are substantially circular in cross-section. Such articles may be used for internally repairing, reinforcing or coupling hollow elongate objects such as pipes.

The tubular articles according to the invention may be integrally formed closed in cross-section. As an alternative a wraparound article may be used. As used herein the term "wraparound" means a cover which can be wrapped around a substrate, and longitudinal edges secured together to form a tubular article around the substrate. Wraparound covers may be closed in any suitable way. For example upstanding flanges which can be held together by clamps or by a channel shaped closure may be provided at or near the longitudinal edges. Longitudinal electrodes may be included in or on the upstanding flanges, or at the base thereof, and/or extending along part of the main body of the cover. A wraparound cover can conveniently be made by extrusion. The electrodes can be embedded in the cover during the extrusion process.

Tubular articles according to the invention may be open at one or both ends.

Articles according to the invention may be coated on their internal and/or external surfaces with adhesive or sealant.

In some embodiments according to the invention, at least a section of the article is convoluted, at least after recovery. Preferably the section is convoluted before recovery, and the convolutions increase their depth (height) after recovery. Where the article is convoluted the wall thickness of the convoluted section is defined as the distance between the extremes of the convolutions, i.e. it is the depth of the convolutions. One or a plurality of convolutions may be used. A typical number is 2 to 7.

Smooth walled articles may also be used which increase their thickness on recovery.

The outer surface of at least the section of the article which increases its thickness, is preferably coated with adhesive or sealant, to enhance the seal to the said surrounding surface.

The section which increases its thickness on recovery may be electroded in any suitable way to cause electrical current to flow through the article. Conveniently the section is electroded so that current flows in or parallel to the plane of the article, for example by annular electrodes embedded in, or positioned on the surface of either end of the section whose thickness increases, or by longitudinal electrodes extending along the length of that section. Annular electrodes will cause current to flow along the length of the article. Longitudinal electrodes will cause current to flow around the circumference of the article.

In some embodiments, the article comprises one or more radially shrinkable sections for recovery into contact with an elongate object within the article. In these cases, the article is preferably coated on its inner surface with adhesive or sealant. The radially shrinkable section may be electroded in any convenient way. One embodiment uses elongate electrodes extending along the length of the article to be radially shrinkable.

Where the radially shrinkable sections are tubular with one or more open ends, it may be desirable to seal between two or more substrates exiting the open end. This can be achieved using a branch-off clip (e.g. as disclosed in U.S. No. 4648924) which brings together circumferentially spaced portions of the walls of the article between the substrates. Preferably an electrically heated branch off clip is used. As an alternative an electrically heated filling piece may be used. The electrically heated clip and filling piece may be powered by the same power supply that is used to heat and recover the article.

One embodiment of articles according to the invention comprises a convoluted first section to which annular electrodes can be connected. This section recovers such that there is an increase in the depth of the convolutions, thereby sealing the article into contact with a surrounding surface. This article preferably has one, preferably two end sections which are radially shrinkable, each of which comprise a pair of elongate electrodes extending along the length of those end sections. Such an article can be used as a wall feedthrough, the first section or sections sealing into contact with the duct in the wall, and the end section sealing to cables passing through the feedthrough.

A preferred composition for the article, is one having the electrical characteristics specified in U.S. patent application Ser. No. 07/242,081, the disclosure of which is incorporated herein by reference. Articles according to that invention have been expanded from X% to Y% to make them heat recoverable, and comprise a conductive polymeric material, the resistivity of which decreases on expansion, as measured in the direction of current flow in at least part of the X–Y expansion range. Other articles according to the invention are heat recoverable, comprise a conductive polymeric material which has a resistivity which increases on recovery as measured in the direction of current flow, throughout the temperature range 20° C. to $T_e$ (extrapolated end temperature as measured according to ASTM D3418-82). Other articles according to that invention have a so called pseudo—PTC ratio (peak resistivity: resistivity at 25° C.) in the range 1½–10, and are connected to electrodes so that current flows parallel to the faces of the article.

Particular examples, of materials that can be used are described in U.S. patent application Ser. No. 07/241,749 the disclosure of which is incorporated herein by reference. One example of a suitable material is 59.4 parts by weight Elvax 460 (an EVA of 18% vinylacetate content and a melt flow index of 2.5, as supplied by Du Pont), 39.6 parts by weight of Vulcan P (a carbon black supplied by Cabot Corporation) and 1 part by weight antioxidant. Other examples are:

| Polymer (parts by weight) | Carbon black (parts by weight) | Antioxidant (parts by weight) |
|---|---|---|
| Marlex* HXM 50100 (59.4) | Vulcan* P (39.6) | (1.0) |
| Elvax* 460 (59.4) | Sevalco* N110 (39.6) | (1.0) |
| Sclair* 11D-1 (59.4) | Ensaco* MS (39.6) | (1.0) |
| Elvax* 770 (59.4) | Vulcan* P (39.6) | (1.0) |

*represents a trademark

The polymeric materials used are as follows:
Marlex is a HDPE supplied by Phillips.
Elvax 460 described earlier.
Sclair 11D-1 is a LLDPE supplied by Du Pont, Canada
Elvax 770 is an EVA supplied by Du Pont.
Vulcan P, Ensaco MS and Sevalco N110 are supplied by Cabot Corporation, Ensagri Willebroek NV and Sevalco Ltd. respectively.

The materials having the above mentioned preferred pseudo PTC ratios and a resistivity which varies with recovery and expansion as specified are particularly useful in applications where there is uneven recovery and/or high recovery (e.g. greater than 150%=2.5X). Thus these materials are particularly preferred for sealing against elongate objects, such as pipes or cables, which have an irregular inner or outer surface.

Where the electrodes extend along the length of the article they are preferably embedded in, or lie on the surface of heat stable flanges extending along at least part of the length of the article. Such flanges, and their advantages are described in U.S. patent application No. Ser. No. 07/241,749, the entire disclosure of which is incorporated by reference.

The electrodes (where longitudinal) may extend along the whole or only part of the length of the article. Where they extend only part way along the length compensatory features are preferably provided to compensate for increase current density at the electrode ends as specified in U.S. patent application Ser. No. 07/241,749.

The whole part may be heated and shrunk simultaneously. Alternatively, by providing interrupted electrodes a sequence of different parts can be heated independently. This is described in U.S. patent application Ser. No. 07/241,658, abandoned, the disclosure of which is incorporated herein by reference.

In article according to the invention the wall thickness of the article may be varied along its length. Also two or more layers of different materials may be used. The second or additional layer may extend along the whole or along any part of the length of the article. They may have electrical properties e.g. room temperature resistivity and resistivity/temperature behaviour, that is the same as, or different to, that of the first material. For example the second or subsequent layers may comprise a material that exhibits traditional PTC behaviour or ZTC (zero temperature coefficent of resistivity behaviour. The effect of the additional layer(s) is that it (they) provide additional material through which electrical current can flow, and hence provide additional heating. By appropriate choice of the resistivity of the material of the additional layer(s) greater heating can be achieved than would be the case were a similar additional thickness of the first material used. This may be advantageous, for example to decrease recovery time in certain regions, or where a higher temperature is required. Therefore in some preferred embodiment second or subsequent layers of material different to the first material are added in selected regions.

Similarly the thermal load of various sections of the article can be varied, for example by adjusting the thickness of the adhesive or sealant on the sections of the article. The sections with the thickest adhesive will take the longest to heat, and hence the amount of heating of the sections is varied.

Another example of using two layers of different material is where certain properties, e.g. flame retardancy, solvent resistance, abrasion resistance, electrical insulation, impact resistance, colour coding are required.

Where two or more layers are used these may be applied separately , for example by sequential extrusion or may be co-extruded.

Embodiments of the invention will now be described by way of example, wherein:

FIG. 1 is a sectional view showing an article according to the invention for sealing between a cable and a hole in a wall, prior to recovery.

Figure 2:
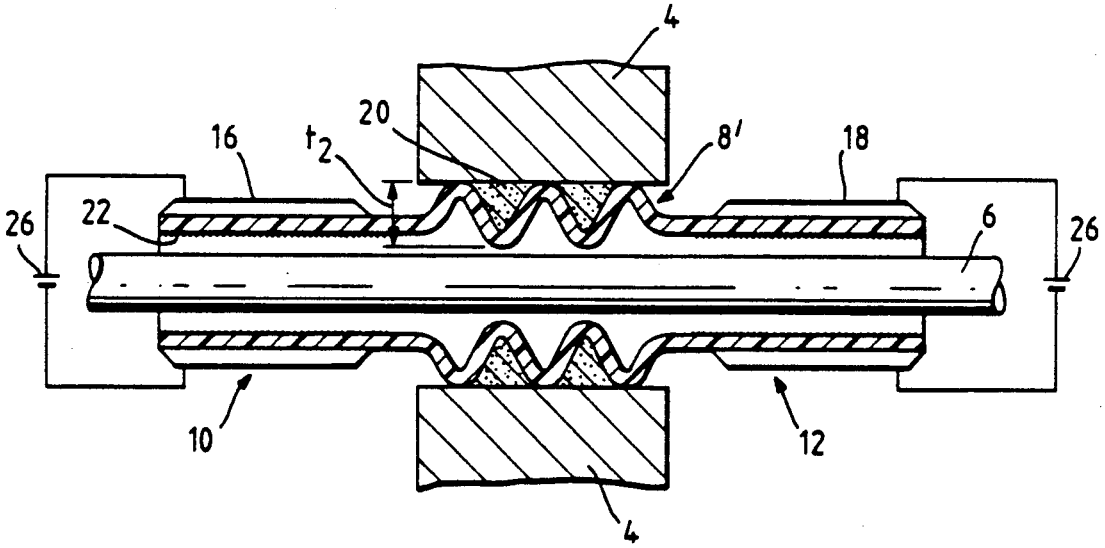
FIG. 2 is a sectional view showing the article of FIG. 1 recovered into seal engagement with the wall.
Figure 3:
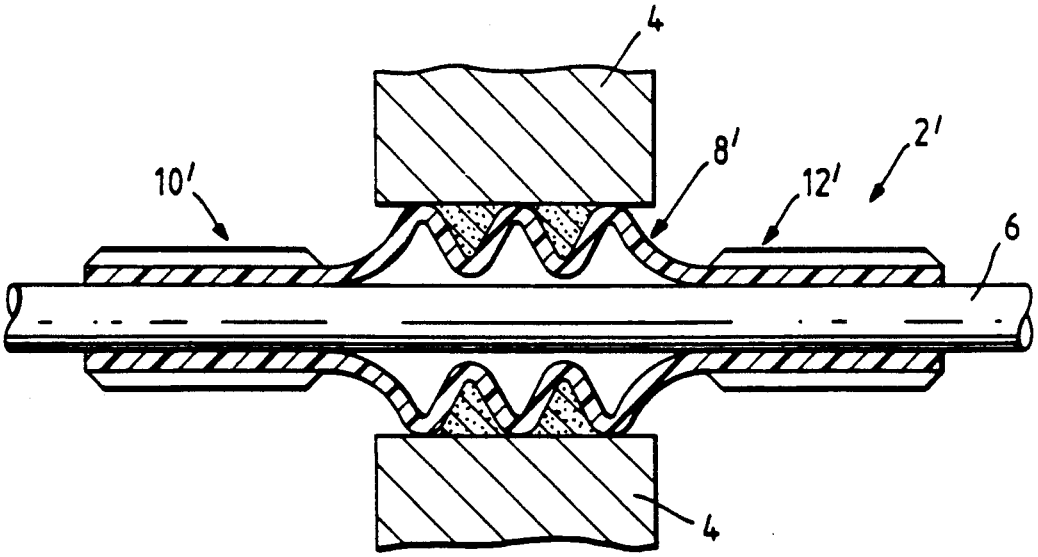
FIG. 3 is a sectional view showing the article of FIG. 2 recovered into engagement with the cable.
Figure 4:
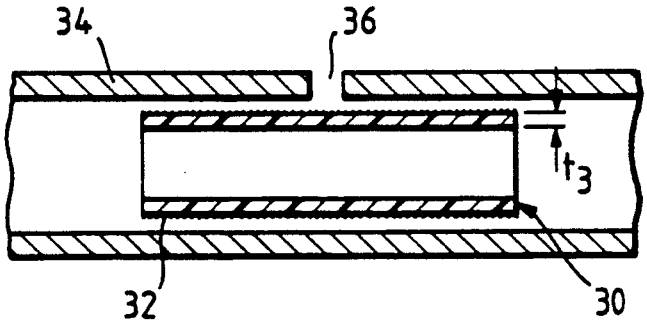
FIGS. 4 and 5 show another article according to the invention, before and after recovery respectively, being used to internally repair a damaged pipe.
Figure 5:
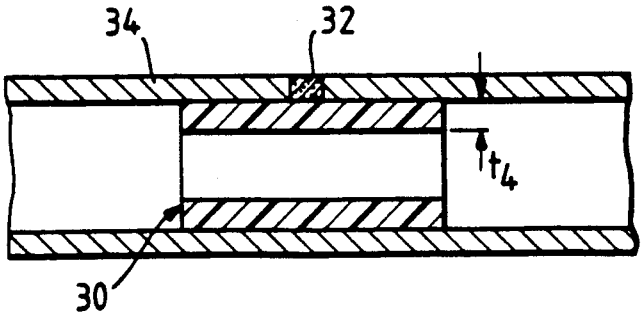
Figure 5:
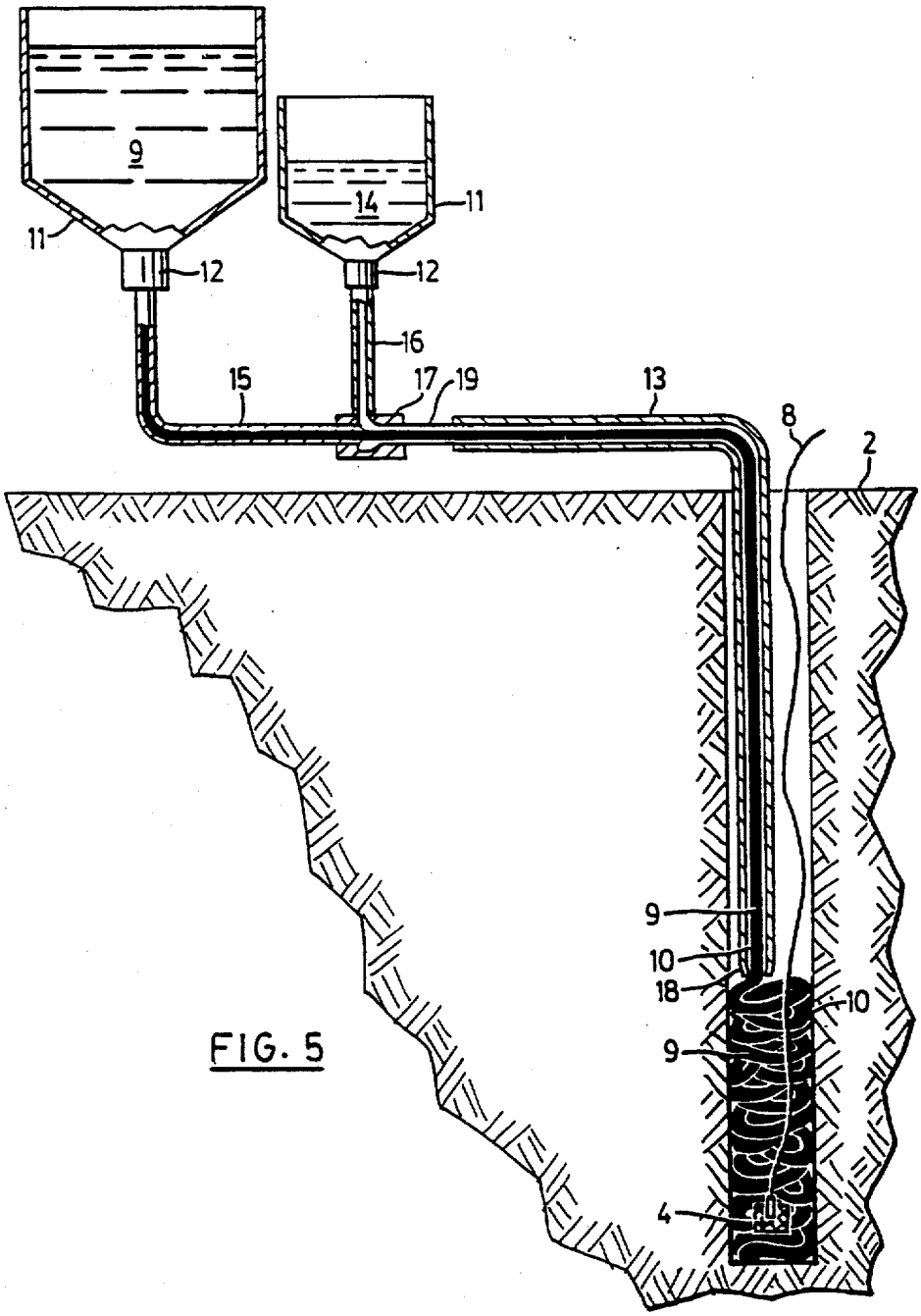

FIG. 2 is a sectional view showing the article of FIG. 1 recovered into sealing engagement with the wall; and FIG. 3 is a sectional view showing the article of FIG. 2 recovered into engagement with the cable; and FIGS. 4 and 5 show another article according to the invention, before and after recovery respectively, being used to internally repair a damaged pipe.

Referring now to the drawings an article 2 according to the invention is used to seal a space between a hole in a wall 4 and a cable 6.

The article comprises an electrically conductive polymeric material. It has a central convoluted section 8 and end plain sections 10 and 12. Convoluted section 8 has been previously deformed by stretching it longitudinally parallel to its main axis, so that on recovery the depth of its convolutions increases, and hence the wall thickness of section 8 increases. End sections 10 and 12 have been previously deformed so that they are radially shrinkable.

Annular braided electrodes 14 of opposite polarity surround the circumference of the article at either end of the convoluted section. Pairs of longitudinal electrodes in the form of silver paint strips 16 and 18, extend along opposite sides of end sections 10 and 12. The silver paint electrodes 16 and 18 are provided on heat stable, conductive polymeric flanges 17 and 19.

The outer surface of convoluted section 8 is coated with adhesive 20. The inner surface of ends 10 and 12 is coated with adhesive 22.

To seal the article to the wall 4, electrodes 14 are first connected to a source of electrical power 24. The connections may be made to power terminals on either side of wall (as shown in FIG. 1), or the wires from one electrode may be trailed through the hole in the wall.

The electrical connection of electrodes 14 causes section 8 of the article to heat. This causes adhesive 20 to melt and flow, and the central section 8 to recover so that the convolutions increase in depth. After recovery the convolutions have increased in depth so that they are in sealing contact with the inner surface of the wall. The wall thickness is thus increased from $t_1$ to $t_2$ (see FIGS. 1 and 2). Sealing is enhanced by adhesive 20 (FIG. 2).

Then connection of the article to cable 6 passing through the article is made. To do this, the electrodes 14 are first removed, to prevent short-circuiting. Then elongate electrodes 16 and 18 (at ends 10 and 12 of the: article) are each connected to separate sources of electrical power 26. This may be done simultaneously or sequentially. The connection causes electrical current to flow around the circumference of each end of the article. This heats and shrinks the ends and also melts and flows the adhesive lining 22 at either end. The recovered ends seal into contact with cable 6.

The installed recovered part is shown in FIG. 3.

Recovered parts are indicated in all drawings by a superscript (').

Instead of the entire section 8 being recoverable, two shorter convoluted sections, at either end of the hole in wall 4 may be used.

Typically the end sections of the article of FIGS. 1–3 can be recovered onto cables of diameter about 1 cm from an initial diameter of say 3–4 cm. In this case the convolutes can increase the wall thickness of the article to fill a void of diameter 5 cm.

FIG. 4 shows another conductive polymeric recoverable article 30 according to the invention. Article 30 is smooth in profile and is coated on its outer surface with adhesive 32. It is used to seal a pipe 34 which is damaged at point 36.

Electrodes (not shown) on the article are connected to a source of electrical power. This heats and recovers the article and melts adhesive 32.

The recovered part is shown in FIG. 5. It has increased its wall thickness from $t_3$ to $t_4$, and adhesive 32 has flowed to fill damaged part 36 in the pipe 32.

The disclosures of the following U.S. patent application filed contemporaneously herewith are also incorporated herein by reference: Ser. Nos. 07/241,749, 07/242,089, 07/242,081 abandoned, 07/241,658 abandoned and 07/241,660.

We claim

1. A tubular heat recoverable article, which has been deformed to make it recoverable, comprising (a) a conductive polymer and (b) electrical connection means, the deformation of the article and the position of the electrical connection means being such that, when the electrical connection means are electrically connected to an appropriate source of electrical power, electrical current flows through the conductive polymer in at least one region of the article, heating and recovering at least the said region of the article, whereby on recovery (i) at least a section of the said region of the article increases in wall thickness, and (ii) a region of the article, at least in its recovered state, is convoluted.

2. An article according to claim 1, wherein said region of the article is also convoluted in its pre-recovered state, the depth of the convolutions increasing on recovery.

3. An article according to claim 1, wherein at least the convoluted region is coated on its outer surface with

4. An article according to claim 1, wherein a first set of electrodes can be attached to a first convoluted section of the article, and connected to a source of electrical power to cause the convolutions to increase their depth, the article also comprising one heat shrinkable end section comprising a second set of electrodes, which are longitudinal, extending substantially parallel to the length of the article, which second set of electrodes can be connected to a source of electrical power to shrink said end.

5. An article according to claim 4, wherein the outer surface of the convoluted section and the inner surface of the said end are coated with adhesive and/or sealant.

* * * * *

UNITED STATES PATENT AND TRADEMARK OFFICE

CERTIFICATE OF CORRECTION

PATENT NO. : 4,990,379

DATED : February 5, 1991

INVENTOR(S) : Jensen, et al.

It is certified that error appears in the above-identified patent and that said Letters Patent is hereby corrected as shown below:

Column 5, line 5, replace "07/241,749" by --07/241,660--.

Column 5, line 57, delete "abandoned,".

Column 6, line 1, replace "resistivity" by --resistivity)--.

Column 8, line 7, after "07/242,081 abandoned," insert --07/241,643,--.

Column 8, lines 7 to 8, after "07/241,658" delete "abandoned".

Column 8:

Claim 3, line 2, after "outer surface with" insert --adhesive or sealant--.

Signed and Sealed this

Seventeenth Day of August, 1993

Bruce Lehman

*Attest:*

BRUCE LEHMAN

*Attesting Officer*

*Commissioner of Patents and Trademarks*